US009830872B2

(12) United States Patent
Kim

(10) Patent No.: US 9,830,872 B2
(45) Date of Patent: Nov. 28, 2017

(54) DISPLAY DRIVER INTEGRATED CIRCUIT COMPRISED OF MULTI-CHIP AND DRIVING METHOD THEREOF

(71) Applicant: Samsung Electronics Co., Ltd., Suwon-Si, Gyeonggi-do (KR)

(72) Inventor: Yang-Hyo Kim, Suwon-si (KR)

(73) Assignee: Samsung Electronics Co., Ltd., Suwon-Si, Gyeonggi-do (KR)

( * ) Notice: Subject to any disclaimer, the term of this patent is extended or adjusted under 35 U.S.C. 154(b) by 65 days.

(21) Appl. No.: 14/607,307

(22) Filed: Jan. 28, 2015

(65) Prior Publication Data

US 2015/0325164 A1 Nov. 12, 2015

(30) Foreign Application Priority Data

May 8, 2014 (KR) ..... 10-2014-0055087

(51) Int. Cl.
*G09G 3/36* (2006.01)
*G09G 3/20* (2006.01)

(52) U.S. Cl.
CPC ..... *G09G 3/3648* (2013.01); *G09G 3/2003* (2013.01); *G09G 3/2074* (2013.01); *G09G 3/3607* (2013.01); *G09G 3/3696* (2013.01); *G09G 2300/0465* (2013.01); *G09G 2310/08* (2013.01); *G09G 2320/0233* (2013.01); *G09G 2340/0457* (2013.01); *G09G 2370/08* (2013.01)

(58) Field of Classification Search
CPC combination set(s) only.
See application file for complete search history.

(56) References Cited

U.S. PATENT DOCUMENTS 4,816,816 A * 3/1989 Usui ..... G09G 3/3611 345/103
6,603,468 B2 8/2003 Ooishi et al.
7,339,582 B2 3/2008 Akahori
2003/0137481 A1* 7/2003 Nishida ..... G09G 3/3644 345/100
2006/0022968 A1* 2/2006 Kondo ..... G09G 3/3208 345/211
2008/0001944 A1* 1/2008 Chang ..... G09G 3/3611 345/214
2008/0111925 A1* 5/2008 Kato ..... G09G 3/3688 348/721
2011/0001765 A1 1/2011 Hyodo et al.
2011/0148852 A1* 6/2011 Kim ..... G09G 3/20 345/213
2011/0149116 A1* 6/2011 Kim ..... H04N 5/335 348/231.99
2014/0062983 A1* 3/2014 Kim ..... G09G 3/2092 345/211

FOREIGN PATENT DOCUMENTS

KR 10-2000-0054912 A 9/2000
KR 10-2004/0070017 A 8/2004

* cited by examiner

*Primary Examiner* — Pegeman Karimi
(74) *Attorney, Agent, or Firm* — Lee & Morse, P.C.

(57) ABSTRACT

A display driver integrated circuit (IC) includes a first driver IC to receive a first image data signal from a host and to process the first data signal; and a second driver IC to receive a second image data signal from the host and to process the second data signal. The first driver IC is to transmit a first part of the first image data signal to the second driver IC. The second driver IC is to transmit a second part of the second image data signal to the first driver IC.

20 Claims, 17 Drawing Sheets

FIG. 4A (UNIT:nsec)

| Clock | | Bus Width | | | |
|---|---|---|---|---|---|
| MHz | Period | 24 | 8 | 4 | 2 |
| 10 | 100 | 200 | 600 | 1200 | 2400 |
| 20 | 50 | 100 | 300 | 600 | 1200 |
| 30 | 33 | 66 | 198 | 396 | 792 |
| 40 | 25 | 50 | 150 | 300 | 600 |
| 50 | 20 | 40 | 120 | 240 | 480 |

NOT TRANSMITTING

FIG. 4B (UNIT:nsec)

| Clock | | Bus Width | | | |
|---|---|---|---|---|---|
| MHz | Period | 24 | 8 | 4 | 2 |
| 10 | 100 | 600 | 1000 | 1600 | 2800 |
| 20 | 50 | 300 | 500 | 800 | 1400 |
| 30 | 33 | 198 | 330 | 528 | 924 |
| 40 | 25 | 150 | 250 | 400 | 700 |
| 50 | 20 | 120 | 200 | 320 | 560 |

NOT TRANSMITTING

DISPLAY DRIVER INTEGRATED CIRCUIT COMPRISED OF MULTI-CHIP AND DRIVING METHOD THEREOF

CROSS-REFERENCE TO RELATED APPLICATION

Korean Patent Application No. 10-2014-0055087 filed on May 8, 2014, and entitled, "Multi-Chip Display Driver Integrated Circuit and Driving Method Thereof," is incorporated by reference herein in its entirety.

BACKGROUND

1. Field

One or more embodiments described herein relate to a multi-chip display driver integrated circuit and a driving method for the same.

2. Description of Related Art

A display device may include a gate driver integrated circuit (IC) and a source driver IC. The gate driver IC sequentially selects gate signal lines of a pixel-cell array and applies a scan injection signal. The source driver IC converts image data to a pixel voltage and applies the pixel voltage to a data signal line.

Because the source driver IC drives a data signal line, the source driver IC may be referred to as a data driver IC. The data driver IC drives a source electrode of the pixel cell. When the gate driver IC selects an injection signal, applies a scan pulse, and controls a thin film transistor (TFT) to be in an on-state, the data driver IC applies a signal voltage to the pixel cell through each of the data signal lines.

The gate driver IC sequentially supplies the injection signal to a gate line of the pixel cell array. The gate driver IC may be a type of a shift register which sequentially generates an on-off signal voltage of the TFT.

Another gate driver IC may includes a shift register, a level shifter, and an output buffer. The shift register generates an injection signal in synchronization with a clock. The output buffer drives a gate electrode which operates as a very large capacitance load.

SUMMARY

In accordance with one embodiment, a display driver integrated circuit (IC) includes a first driver IC to receive a first image data signal from a host and to process the first data signal; and a second driver IC to receive a second image data signal from the host and to process the second data signal, wherein the first driver IC is to transmit a first part of the first image data signal to the second driver IC, and the second driver IC is to transmit a second part of the second image data signal to the first driver IC.

The first driver IC may process the first image data signal using the second part and may transmit the processed first image data signal to a display panel. When the first image data signal includes pixel information corresponding to a left region of the display panel, the first part may include pixel information corresponding to a boundary of the left region. An order of pixels in the first image data signal may be inverted by an application processor in the host.

The second driver IC may process the second image data signal using the first part and may transmit the processed second image data signal to a display panel. When the second image data signal includes pixel information corresponding to a right region of the display panel, the second part may include pixel information corresponding to a boundary of the right region.

The first driver IC may include a first data buffer including at least one first line buffer to store the first image data signal; a first line buffer controller to control the at least one first line buffer; and a first intra interface controller to transmit the first part and to receive the second part. The second driver IC may include a second data buffer including at least one second line buffer to store the second image data signal; a second line buffer controller to control the at least one second line buffer; and a second intra interface controller to transmit the second part and receive the first part.

The first data buffer may receive the first image data signal in synchronization with a first horizontal synch signal and may output the first image data signal to a display panel in synchronization with the first horizontal synch signal, and the second data buffer may receive the second image data signal in synchronization with a second horizontal synch signal and may output the second image data signal in synchronization with the first horizontal synch signal to the display panel.

Each of the at least one first and second line buffers may include a half left line buffer and a half right line buffer, and each of the half left line buffer and the half right line buffer may independently perform a read operation or a write operation. The first driver IC may include a pixel buffer to store the second part received through the first intra interface controller, and the second driver IC may include a pixel buffer to store the first part received through the second intra interface controller.

Each of the first and second driver ICs may include an image processor to process the first or second image data signals, and the image processer may control a contrast or sharpness with regard to the first or second image data signal. Each of the first and second driver ICs may be embodied in one independent IC. Each of the first and second parts may be transmitted during a horizontal porch time.

The first driver IC may receive the first image data signal via a mobile industry processor interface (MIPI), the first driver IC may transmit the first part to the second driver IC using a serial peripheral interface (SPI) bus, the second driver IC may receive the second image data signal via the MIPI, and the second driver IC may transmit the second part to the first driver IC using the SPI bus.

In accordance with another embodiment, a method for driving a display driver IC including a first and second driver IC includes receiving, by the first driver IC, a first image data signal from a host; receiving, by the second driver IC, a second image data signal from the host; transmitting a first part of the first image data signal from the first driver IC to the second driver IC; and transmitting a second part of the second image data signal from the second driver IC to the first driver IC.

The method may include processing, by the first driver IC, the first image data signal using the second part. The method may include transmitting the processed first image data signal from the first driver IC to a display panel. The method may include processing, by the second driver IC, the second image data signal using the first part. The method may include transmitting the processed second image data signal fro the second driver IC to a display panel.

In accordance with another embodiment, a mobile device includes an application processor; and a display driver IC to receive first and second image data signals from the application processor, wherein the display driver IC includes: a first driver IC to receive a first image data signal from a host and to process the first data signal; and a second driver IC to receive a second image data signal from the host and to process the second data signal, wherein the first driver IC is to transmit a first part of the first image data signal to the second driver IC, and the second driver IC is to transmit a second part of the second image data signal to the first driver IC.

The first driver IC may process the first image data signal using the second part and is to transmit the processed first image data signal to a display panel. The first image data signal may include pixel information corresponding to a left region of the display panel, and the first part may include pixel information corresponding to a boundary of the left region.

The second driver IC may process the second image data signal using the first part and may transmit the processed second image data signal to a display panel. When the second image data signal includes pixel information corresponding to a right region of the display panel, the second part may include pixel information corresponding to a boundary of the right region.

In accordance with another embodiment, an apparatus includes a first driver to process a first data signal; and a second driver to process a second data signal, wherein the first data signal includes pixel information corresponding to a first region of an image and the second data signal includes pixel information corresponding to a second region of the image, and wherein the first driver is to transfer a portion of the first data signal to the second driver during a horizontal porch time and the second driver is to transfer a portion of the second image data signal to the first driver during the horizontal porch time to generate the image.

The first driver may include a first controller to process the first data signal for output through a first set of column drivers, and the second driver may include a second controller to process the second data signal through a second set of column drivers. The first driver and the second driver may be included in different integrated circuit (IC) chips.

The first driver may process the first data signal based on the portion of the second data signal transferred from the second driver, and the second driver may process the second data signal based on the portion of the first data signal transferred from the first driver. At least one of the portion of the first data signal or the portion of the second data signal may correspond to a boundary between the first region and the second region of the image.

BRIEF DESCRIPTION OF THE DRAWINGS

Features will become apparent to those of skill in the art by describing in detail exemplary embodiments with reference to the attached drawings in which:

FIG. 4A illustrates examples of clock frequencies and bus widths when transmitting two pixels during a horizontal porch time, and FIG. 4B illustrates examples of clock frequencies and bus widths when transmitting the two pixels and an address corresponding to each of the two pixels;

DETAILED DESCRIPTION

Example embodiments are described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements. Other words used to describe relationships between elements should be interpreted in a like fashion (i.e., "between" versus "directly between," "adjacent" versus "directly adjacent," etc.).

Meanwhile, when it is possible to implement any embodiment in any other way, a function or an operation specified in a specific block may be performed differently from a flow specified in a flowchart. For example, consecutive two blocks may actually perform the function or the operation simultaneously, and the two blocks may perform the function or the operation conversely according to a related operation or function.

Figure 1:
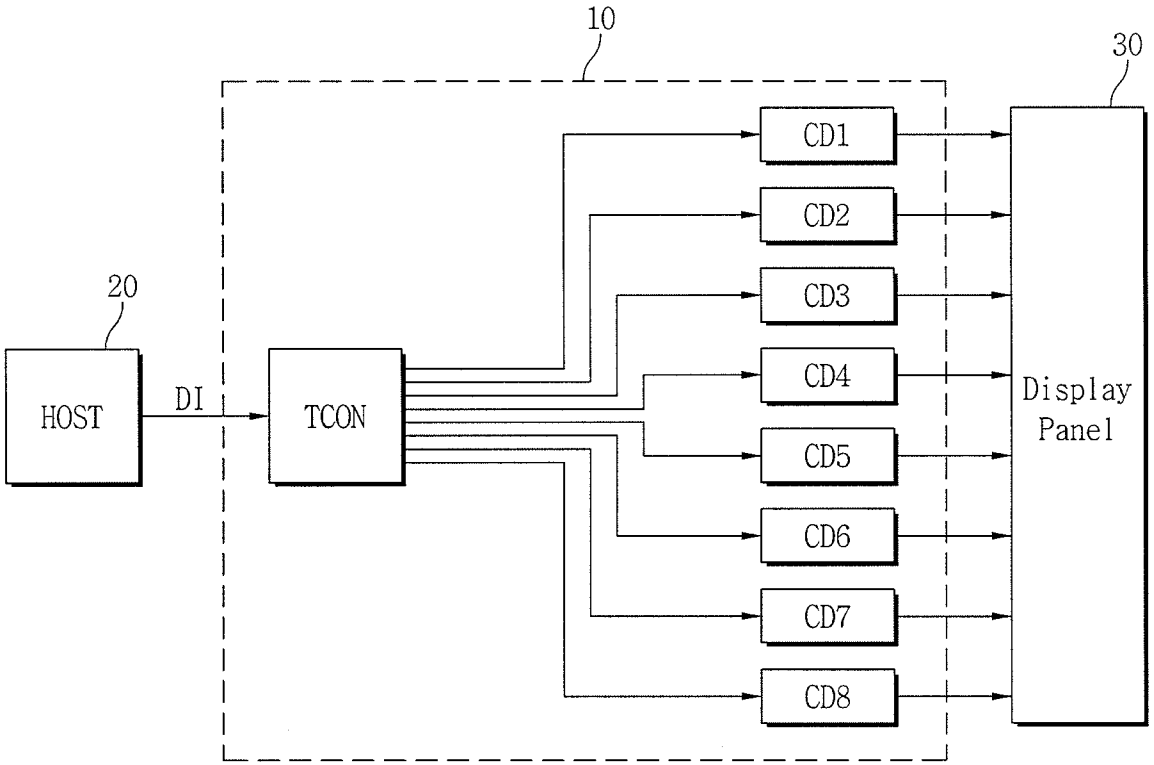
FIG. 1 RELATED ART
FIG. 1 illustrates a related-art display driver integrated circuit.

FIG. 1 illustrating a related-art display driver integrated circuit (IC) 10 which receives image data signal DI from a host 20. The display driver IC 10 transmits the received image data signal DI to the display panel 30. The display panel 30 displays an image corresponding to the image data signal DI.

The display driver IC 10 includes a timing controller TCON and first to eighth column drivers CD1 to CD8. Eight column drivers are illustrated, and the display driver IC 10 may be embodied in a single chip. The timing controller TCON distributes the image data signal DI from the host 20 to each of the first to eighth column drivers CD1 to CD8. The display panel 30 receives the image data signal DI through the first to eighth column drivers CD1 to CD8.

Figure 2:
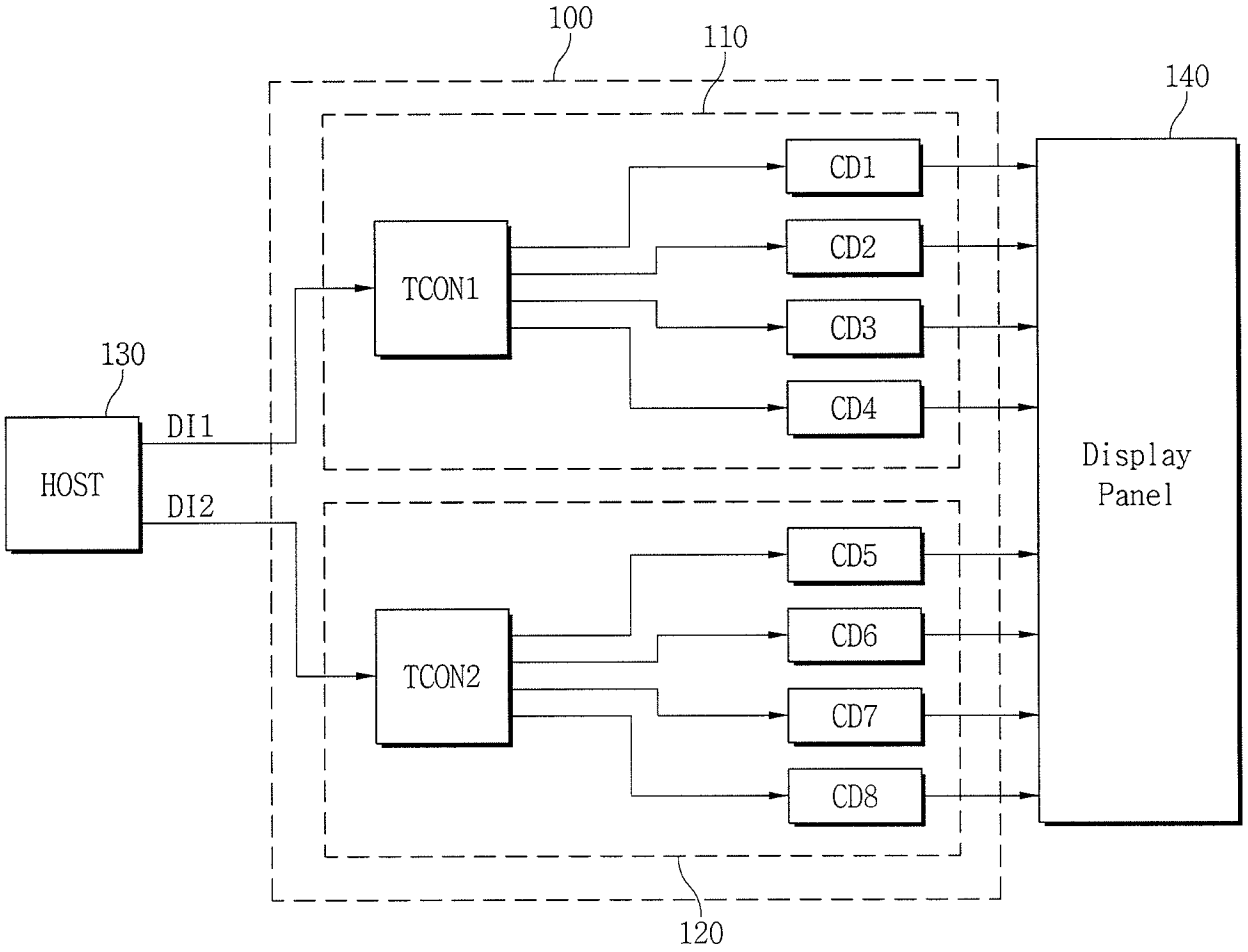
FIG. 2 illustrates an embodiment of a display driver IC.

FIG. 2 illustrates an embodiment of a display driver IC 100 in a multi-chip. In this embodiment, the display driver IC 100 is illustrated to include two chips. The display driver IC 100 may include a different number of chips in other embodiments. For example, an alternative embodiment may include a same number of data image signals as chips, and each chip may include more or fewer than four column drivers as shown in the drawings.

The display driver IC 100 includes a first driver IC 110 and a second driver IC 120. In this embodiment, each of the first and second driver ICs 110 and 120 is embodied in one independent chip.

The host 130 divides image data corresponding to one frame into two image data signals (e.g., first and second image data signals DI1 and DI2). The host 130 transmits the first image data signal DI1 to the first driver IC 110. The host 130 transmits the second image data signal DI2 to the second driver IC 120. The host 130 may include or be embodied in, for example, an application processor.

For example, the first image data signal DI1 may include pixel information to display a left region of the display panel 140. The second image data signal DI2 may include pixel information to display a right region of the display panel 140. The display driver IC 100 receives the first and second image data signals DI1 and DI2 from the host 130, e.g., the first driver IC 110 receives the first image data signal DI1 from the host 130 and the second driver IC 120 receives the second image data signal DI2 from the host 130.

The display driver IC 100 transmits the first and second image data signals DI1 and DI2 to the display panel 140. The first driver IC 110 includes first to fourth column drivers CD1 to CD4 and a first timing controller TCON1. The second driver IC 120 includes fifth to eighth column drivers CD5 to CD8 and a second timing controller TCON2. The number of column drivers may be 8 or a different number.

The host 130 transmits the first image data signal DI1 to the first timing controller TCON1 through a mobile industry processor interface (MIPI). The first timing controller TCON1 processes the first image data signal DI1. The first timing controller TCON1 distributes the processed first image data signal DI1 to each of the first to fourth column drivers CD1 to CD4.

The host 130 transmits the second image data signal DI2 to the second timing controller TCON2 through a MIPI. The second timing controller TCON2 processes the second image data signal DI2. The second timing controller TCON2 distributes the processed second image data signal DI2 to each of the fifth to eighth column drivers CD5 to CD8.

The display panel 140 receives the processed first image data signal DI1 from each of the first to fourth column drivers CD1 to CD4, and the processed second image data signal DI2 from each of the fifth to eighth column drivers CD5 to CD8. The display panel 140 displays an image corresponding to the first and second image data signals DI1 and DI2.

To process pixels in the first image data signal DI1, the first driver IC 110 may use information about pixels which are respectively adjacent to the pixels. For example, the first driver IC 110 may use information about part of the pixels in the second image data signal DI2 to process pixels which correspond to a boundary of pixels in the first image data signal DI1.

To process pixels in the second image data signal DI2, the second driver IC 120 may use information about pixels which are respectively adjacent to the pixels. For example, the second driver IC 120 may use information about part of the pixels in the first image data signal DI1 to process pixels which correspond to a boundary of pixels in the second image data signal DI2.

The first driver IC 110 may be referred to as a master 110 to denote that it provides part of image data. The second driver IC 120 may be referred to as a slave 120 to denote that it receives part of image data. Each of the first and second driver ICs 110 and 120 may have the same configuration, but this is not necessary. Also, the first or second driver IC 110 or 120 may be determined by the host 130.

Figure 3:
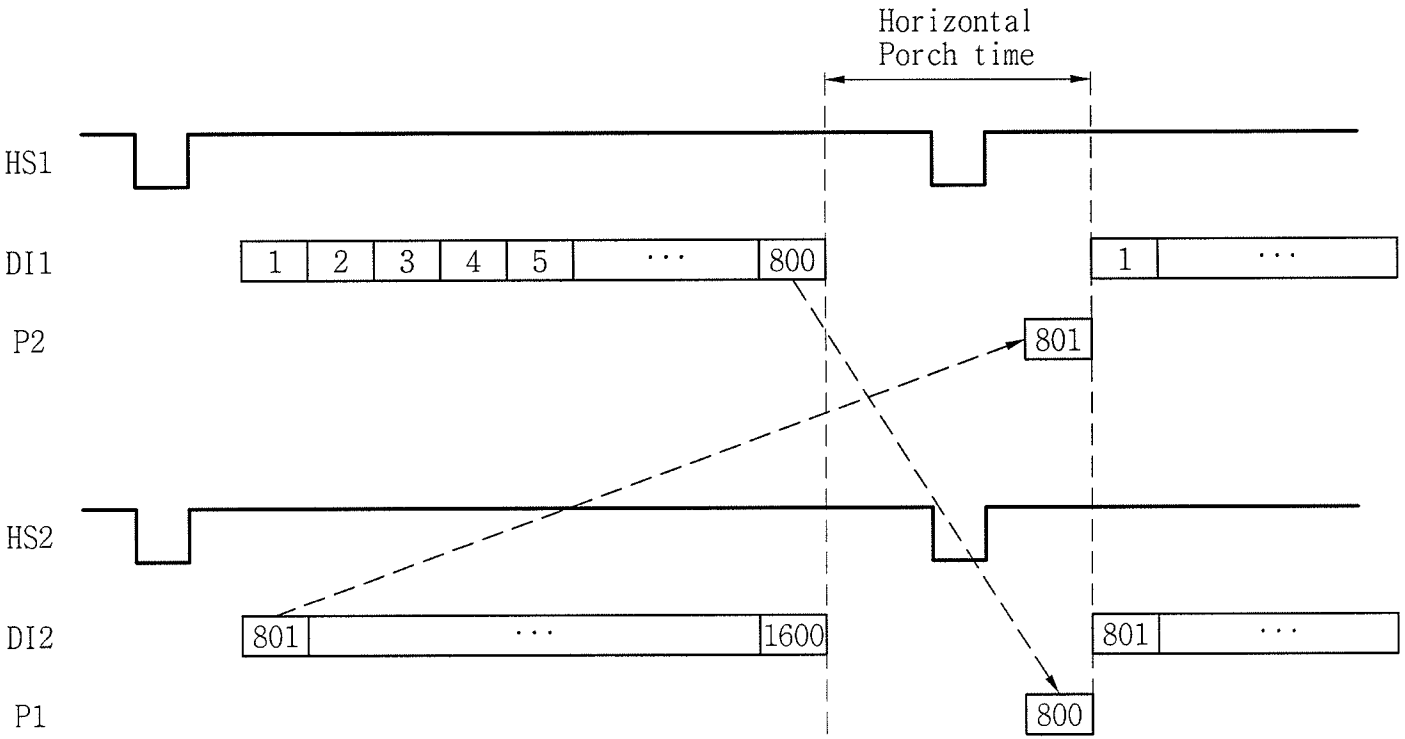
FIG. 3 illustrates an embodiment of a timing diagram for controlling the display driver IC in FIG. 2.

FIG. 3 is a conceptual diagram describing operation of the display driver IC in FIG. 2 according to one embodiment. Referring to FIGS. 2 and 3, the host 130 transmits the first image data signal DI1 to the master 110 after the host 130 toggles a first horizontal synchronization signal HS1 once. The host 130 transmits the second image data signal DI2 to the slave 120 after the host 130 toggles a second horizontal synchronization signal HS2 once.

The master 110 uses the second and fourth pixel information in order to process the third pixel in the first image data signal DI1. Also, the master 110 uses the first, second, fourth, and fifth pixel information in order to process the third pixel in the first image data signal DI1.

The master 110 uses the $801^{st}$ pixel information, included in the second image data signal DI2, in order to process the $800^{th}$ pixel included in the first image data signal DI1. However, the master 110 may receive the first image data signal DI1, but may not receive the second image data signal DI2.

Likewise, the slave 120 uses the $800^{th}$ pixel information, included in the first image data signal DI1 in order to process the $801^{st}$ pixel included in the second image data signal DI2. However, the slave 120 may receive the second image data signal DI2, but may not receive the first image data signal DI1.

When transmitting part (e.g., $800^{th}$ pixel information) of the first image data signal DI1 to the slave 120, the master 110 may transmit the part of the first image data signal DI1 during a horizontal porch time. The horizontal porch time may be one specified in a video specification. Likewise, when transmitting part (e.g., $801^{st}$ pixel information) of the second image data signal DI2 to the master 110, the slave 120 may transmit the part of the second image data signal DI2 during the horizontal porch time.

Accordingly, the master 110 may increase a clock frequency or a bus width in order to transmit the part of the first image data signal DI1 during the horizontal porch time. The slave 120 may increase a clock frequency or a bus width in order to transmit the part of the second image data signal DI2 during the horizontal porch time.

FIG. 4A is a table illustrating an example of clock frequencies and bus widths when transmitting two pixels during a horizontal porch time. Information about one pixel may include, for example, red information, green information, and blue information, each of which include 8 bits. Accordingly, the information about one pixel may be composed of 24 bits. When a speed of a bus is 1 Gbps, a horizontal porch time is 450 nsec. A different number of bits or a different speed may be used in other embodiments.

Referring to FIGS. 2 and 4A, the master 110 or the slave 120 transmits two pixel data signals (e.g., 48 bits) during a horizontal porch time. When a bus width is 24 bits and a clock frequency is from 10 MHz to 50 MHz, the master 110 may transmit the two pixel data signals to the slave 120 during the horizontal porch time. When a bus width is 8 bits and a clock frequency is from 20 MHz to 50 MHz, the master 110 may transmit the two pixel data signals to the slave 120 during the horizontal porch time. When a bus width is 4 bits and a clock frequency is from 30 MHz to 50

MHz, the master 110 may transmit the two pixel data signals to the slave 120 during the horizontal porch time.

However, when a bus width is 2 bits and a clock frequency is in a range of 10 MHz to 50 MHz, the master 110 may not transmit the two pixel data signals to the slave 120 during the horizontal porch time. For example, when the time to transmit the two pixel data signals exceeds 450 nsec, the master 110 may not transmit the two pixel data signals to the slave 120.

FIG. 4B is a table illustrating examples of clock frequencies and bus widths when transmitting the two pixels and an address corresponding to each of the two pixels during the horizontal porch time. Referring to FIGS. 2 and 4B, the master 110 or the slave 120 transmits the two pixel data signals (e.g., 48 bits) and an address corresponding to each of the two pixel data signals during the horizontal porch time.

When a bus width is 24 bits and a clock frequency is in a range of 20 MHz to 50 MHz, the master 110 may transmit the two pixel data signals and the address corresponding to each of the two pixel data signals to the slave 120 during the horizontal porch time. When a bus width is 8 bits and a clock frequency is in a range of 30 MHz to 50 MHz, the master 110 may transmit the two pixel data signals and the address corresponding to the two pixel data signals to the slave 120 during the horizontal porch time. When a bus width is 4 bits and a clock frequency is in a range of 40 MHz to 50 MHz, the master 110 may transmit the two pixel data signals and the an address corresponding to the two pixel data signals to the slave 120 during the horizontal porch time.

However, when a bus width is 2 bits and a clock frequency is in a range of 10 MHz to 50 MHz, the master 110 may not transmit the two pixel data signals and the addresses corresponding to the two pixel data signals to the slave 120 during the horizontal porch time. For example, when the time to transmit 2 pixel data signals exceeds 450 nsec, the master 110 may not transmit the two pixel data signals and the addresses corresponding to the two pixel data signals to the slave 120.

Figure 5A:
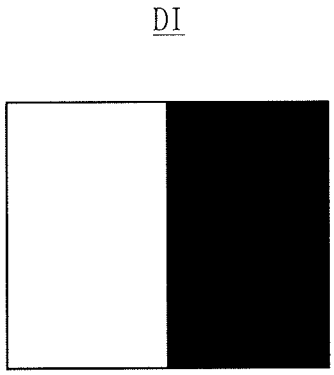
FIGS. 5A to 5C illustrate operation of the display driver IC in FIG. 2 according to additional embodiments.
Figure 5B:
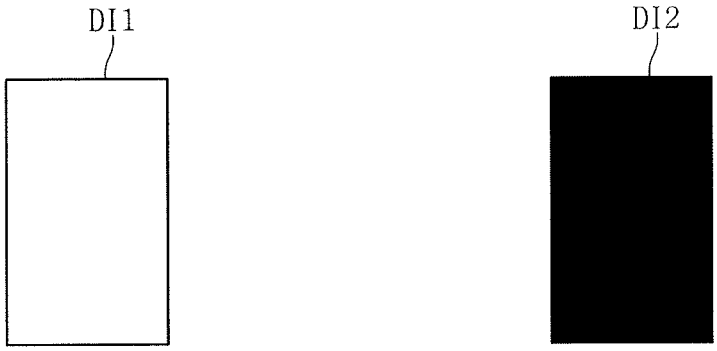
Figure 5C:
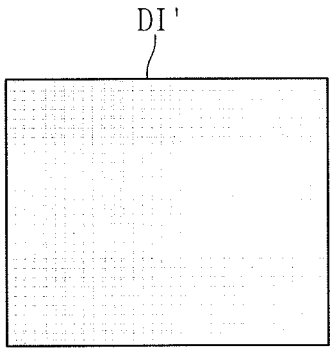

FIGS. 5A to 5C are conceptual diagrams for describing another operation of the display driver IC in FIG. 2. Referring to FIGS. 1, 2, 5A, 5B, and 5C, the image data signal DI in FIG. 5A may include information about white pixels and black pixels. For example, as illustrated in FIG. 5B, the image data signal DI may include the first image data signal DI1 including only white pixels and the second image data signal DI2 including only black pixels.

The host 130 transmits the first image data signal DI1 including only white pixels to the master 110 and the second image data signal DI2 including only black pixels to the slave 120. When the master 110 processes the first image data signal DI1, an image corresponding to the first image data signal DI1 may have very high brightness. On the other hand, when the slave 120 processes the second image data signal DI2, an image corresponding to the second image data signal DI2 may have very low brightness.

However, when a display driver IC 10 embodied in a single chip processes the image data signal DI in FIG. 5A, the display driver IC 10 may process pixels in the first image data signal DI1 and pixels in the second image data signal DI2 without separating the image data signal DI into the first image data signal DI1 and the second image data signal DI2. Accordingly, an outcome of processing the image data signal DI in FIG. 5A may be similar to an outcome of processing the image data signal DI' in FIG. 5C.

Figure 6:
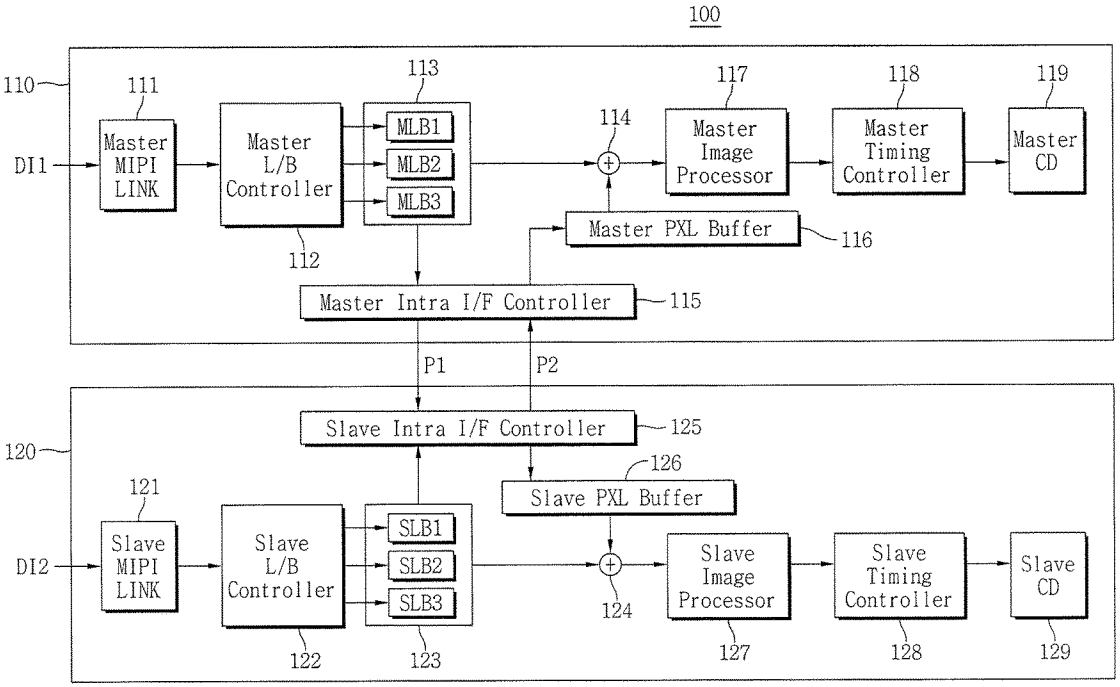
FIG. 6 illustrates an embodiment of the display driver IC in FIG. 2.

FIG. 6 illustrates an embodiment of the display driver IC 100 in FIG. 2. Referring to FIGS. 2 and 6, the display driver IC 100 includes a master 110 and a slave 120. The master 110 includes the first driver IC 110, and the slave 120 includes the second drive IC 120.

The master 110 includes a master MIPI link 111, a master line buffer (L/B) controller 112, a master data buffer 113, a master summation 114, a master intra interface (I/F) controller 115, a master pixel (PXL) buffer 116, a master image processor 117, a master timing controller 118, and a master column driver (CD) 119.

The master MIPI link 111 may receive the first image data signal DI1 from the host 130 according to a MIPI method. The host 130 may be embodied, for example, in an application processor.

The master L/B controller 112 may control the master data buffer 113 to store the first image data signal DI1, which is received through the master MIPI link 111, to the master data buffer 113. The master data buffer 113 includes first to third master L/Bs MLB1 to MLB3.

The master data buffer 113 transmits the first image data signal to the master summation 114. Operation of the master L/B controller 112 and the first to third master L/Bs MLB1 to MLB3 is described with reference to FIG. 7.

The master intra I/F controller 115 transmits a first part P1 of the first image data signal DI1 to a slave intra I/F controller 125. For example, the master intra I/F controller 115 may transmit the first part P1 to the slave intra I/F controller 125 using a serial peripheral I/F (SPI) bus.

The slave intra I/F controller 125 transmits a second part P2 of the second image data signal DI2 to the master intra I/F controller 115. For example, the slave intra I/F controller 125 may transmit the second part P2 to the master intra I/F controller 115 using a SPI bus.

The master pixel buffer 116 stores the second part P2. Further, one of the first to third master L/Bs MLB1 to MLB3 may store the second part P2.

The master summation 114 combines the first image data signal DI1 with the second part P2 and transmits a result to the master image processor 117. The master image processor 117 may control contrast or sharpness with regard to the first image data signal DI1.

The master timing controller 118 may transmit the result, which is processed by the master image processor 117, to the master CD 119. The master CD 119 may control a display panel 140 to display the processed result.

When the display panel 140 supports a wide quad extended graphics array (WQXGA), the display panel 140 has a 1600×2560 resolution. For example, based on the horizontal axis, the first image data signal DI1 includes image information about the first to $800^{th}$ pixels and the second image data signal DI2 includes image information about the $801^{st}$ to $1600^{th}$ pixels. The first part P1 may include information about the $800^{th}$ pixel or the $799^{th}$ and $800^{th}$ pixels. The second part P2 may include information about the $801^{st}$ pixel or the $801^{st}$ and $802^{nd}$ pixels.

When the master 110 controls the display panel 140 to display a left region of the display panel 140, the first image data signal DI1 may include image information about pixels corresponding to the left region. When the slave 120 controls the display panel 140 to display a right region of the display panel 140, the second image data signal DI2 may include image information about pixels corresponding to the right region. The first part P1 may include image information about pixels corresponding to a boundary of the left region. The second part P2 may include image information about pixels corresponding to a boundary of the right region.

The slave 120 includes a slave MIPI link 121, a slave L/B controller 122, a slave data buffer 123, a slave summation 124, the slave intra I/F controller 125, a slave PXL buffer 126, a slave image processor 127, a slave timing controller 128, and a slave CD 129. The master 110 and slave 120 may have the same configuration and perform the same operations.

Figure 7:
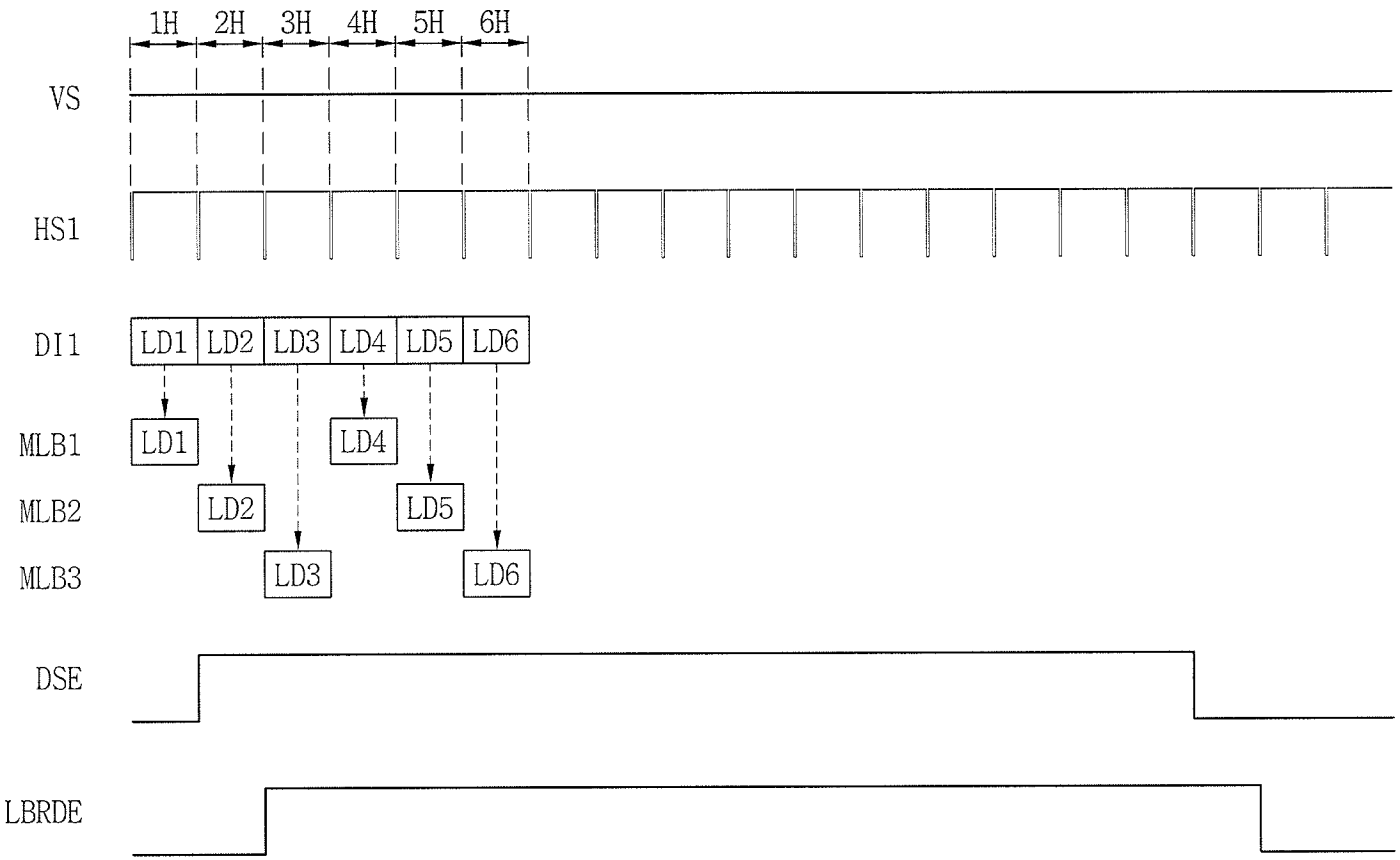
FIG. 7 illustrates operation of the display driver IC in FIG. 6 according to one embodiment.

FIG. 7 illustrates operation of the display driver IC in FIG. 6 according to one embodiment. Referring to FIGS. 6 and 7, a vertical signal VS is activated. During a first horizontal time 1H, the first master L/B MLB1 stores a first left image data signal LD1.

During a second horizontal time 2H, the second master L/B MLB2 stores a second left image data signal LD2. When a data sharing enable signal DSE is enabled, the master 110 transmits information (e.g., the first part P1) about pixels corresponding to a boundary of the first left image data signal LD1 to the slave 120.

During a third horizontal time 3H, the third master L/B MLB3 stores a third left image data signal LD3. In addition, the master 110 transmits information about pixels corresponding to a boundary of the second left image data signal LD2 to the slave 120.

When a L/B read data enable signal LBRDE is enabled, the master 110 transmits the first left image data signal LD1, which is stored in the first master L/B MLB1, to the master CD 119. For example, the first left image data signal LD1 is transmitted to the master CD 119 after two periods of horizontal time. Accordingly, the master 110 may have sufficient time to transmit information about pixels corresponding to a boundary of the first left image data signal LD1 to the slave 120.

During a fourth horizontal time 4H, the first master L/B MLB1 stores a fourth left image data signal LD4. In addition, the master 110 transmits information about pixels corresponding to a boundary of the third left image data signal LD3 to the slave 120. Further, the master 110 transmits the second left image data signal LD2, which is stored in the second master L/B MLB2, to the master CD 119.

During a fifth horizontal time 5H, the second master L/B MLB2 stores a fifth left image data signal LD5. In addition, the master 110 transmits information about pixels corresponding to a boundary of the fourth left image data signal LD4 to the slave 120. Further, the master 110 transmits the third left image data signal LD3, which is stored in the third master L/B MLB3, to the master CD 119.

During a sixth horizontal time 6H, the third master L/B MLB3 stores a sixth left image data signal LD6. In addition, the master 110 transmits information about pixels corresponding to a boundary of the fifth left image data signal LD5 to the slave 120. Further, the master 110 transmits the fourth left image data signal LD4, which is stored in the first master L/B MLB1, to the master CD 119.

Figure 8:
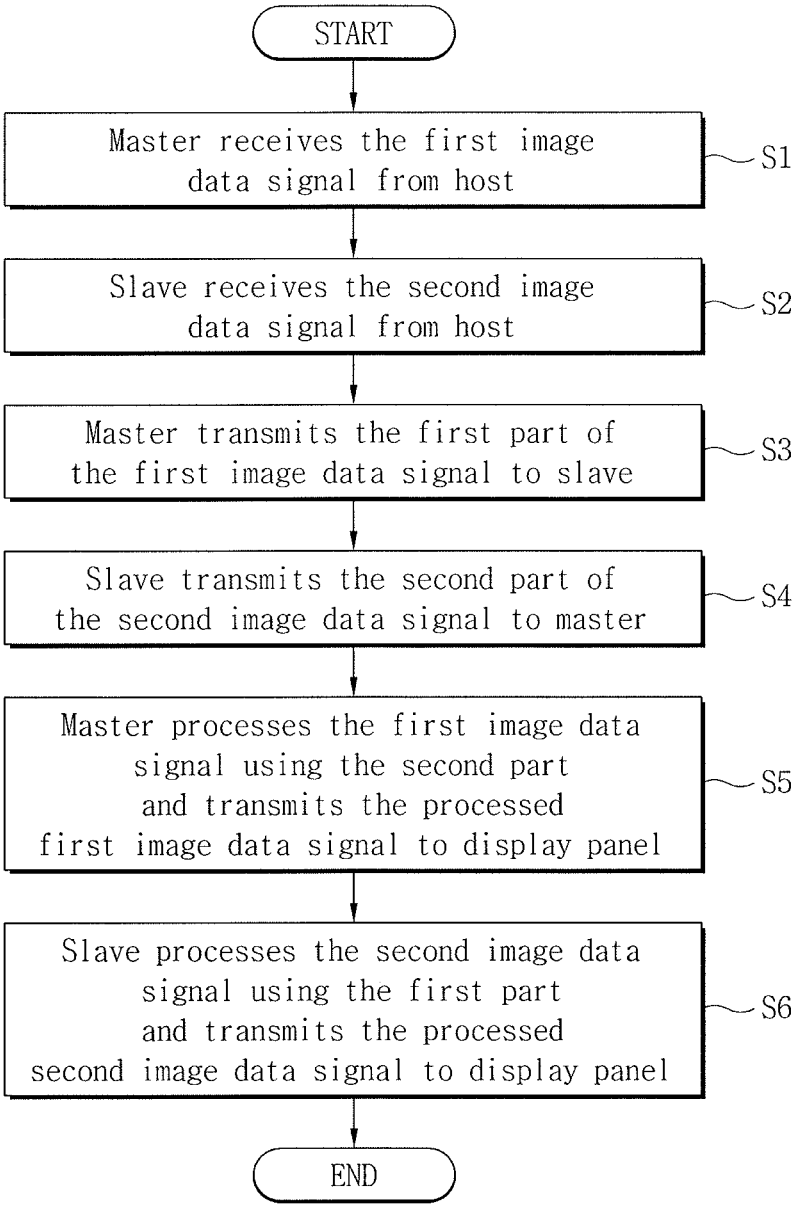
FIG. 8 illustrates operation of the display driver IC in FIG. 6 according to one embodiment.

FIG. 8 illustrates operation of the display driver IC in FIG. 6 according to one embodiment. Referring to FIGS. 2, 6, and 8, in operation S1, the master 110 receives the first image data signal DI1 from the host 130.

In operation S2, the slave 120 receives the second image data signal DI2 from the host 130. When the master 110 displays an image corresponding to a left region of the display panel 140, the first image data signal DI1 may include information about pixels corresponding to the left region. When the slave 120 displays an image corresponding to a right region of the display panel 140, the second image data signal DI2 may include information about pixels corresponding to the right region.

The first part P1 may include information about pixels corresponding to a boundary of the left region. The second part P2 may include information about pixels corresponding to a boundary of the right region.

In operation S3, the master 110 transmits the first part P1 of the first image data signal DI1 to the slave 120.

In operation S4, the slave 120 transmits the second part P2 of the second image data signal DI2 to the master 110.

In operation S5, the master 110 processes the first image data signal DI1 using the second part P2 and transmits the processed first image data signal DI1 to the display panel 140.

In operation S6, the slave 120 processes the second image data signal DI2 using the first part P1 and transmits the processed second image data signal D12 to the display panel 140.

Figure 9:
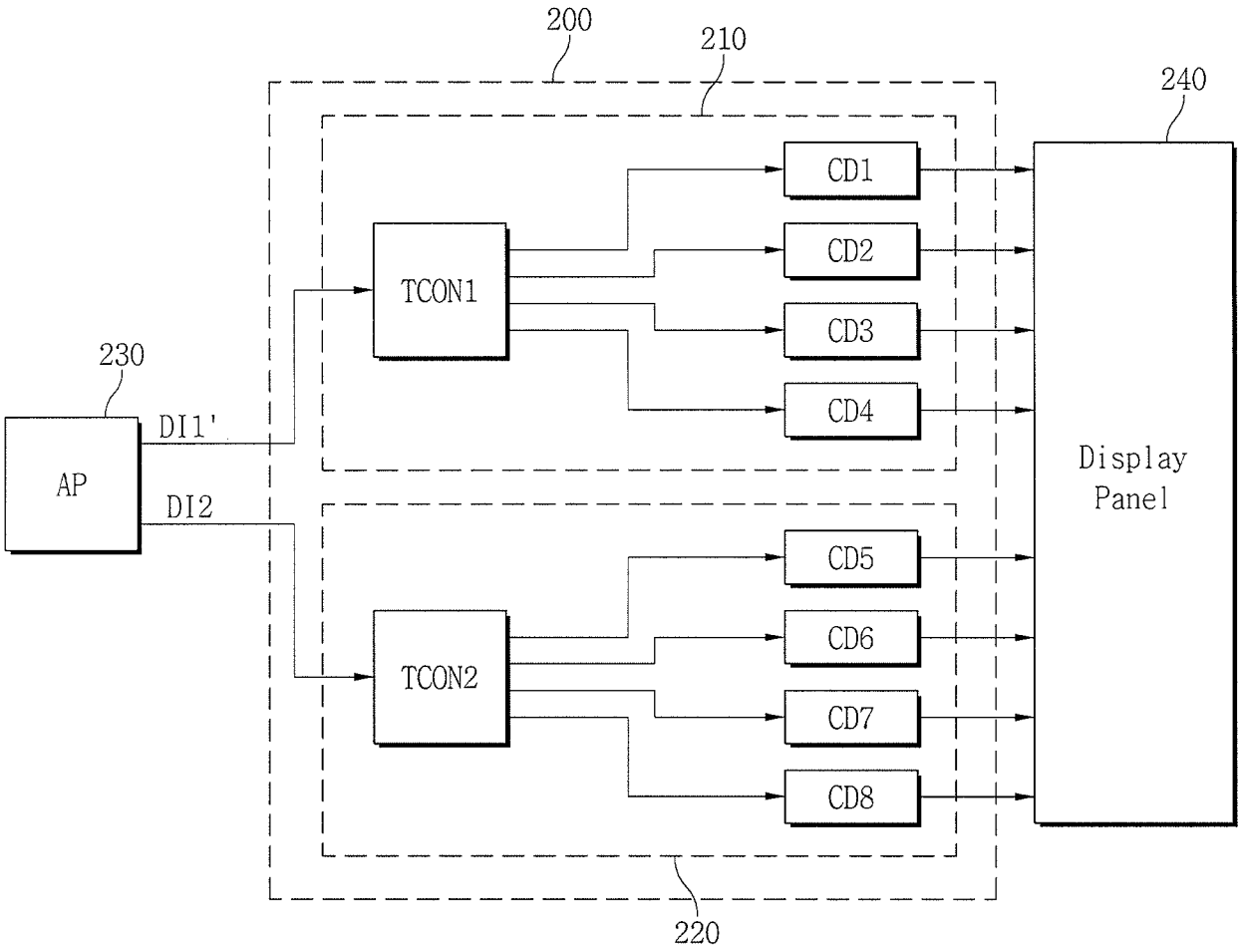
FIG. 9 illustrates another embodiment of a display driver IC.

FIG. 9 illustrates another embodiment of a display driver IC 200 which includes the same configuration as the display driver IC 100 in FIG. 2. An application processor (AP) 230 transmits a revised image data signal DI1' to a master timing controller TCON1 and the second image data signal DI2 to a slave timing controller TCON2.

A pixel order of the revised first image data signal DI1' may be an inverted pixel order of the first image data signal D11. For example, when a pixel order of the first image data signal DI1 is from the first pixel to the $800^{th}$ pixel and a pixel order of the second image data signal DI2 is from the $801^{st}$ pixel to the $1600^{th}$ pixel, a pixel order of the revised first image data signal DI1' may be from the $800^{th}$ pixel to the first pixel.

Figure 10:
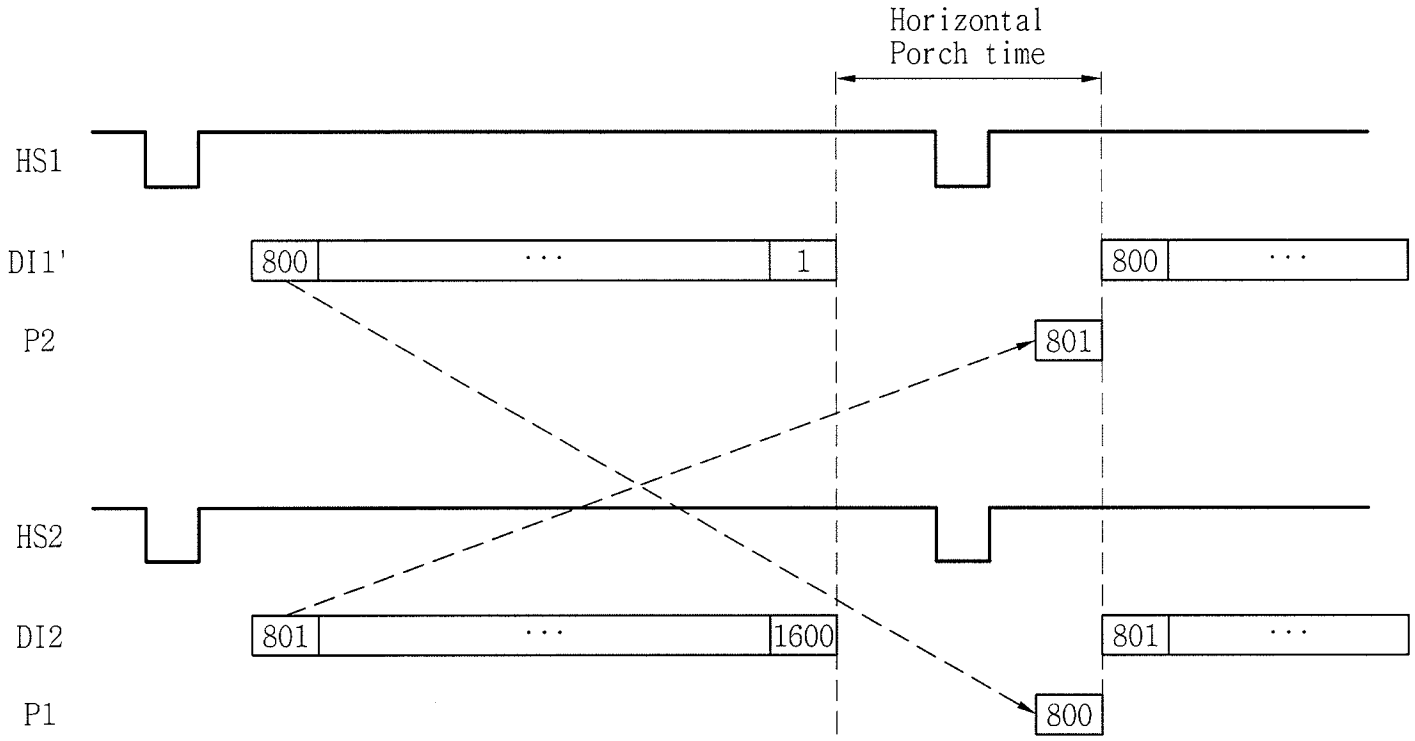
FIG. 10 illustrates operation of the display driver IC in FIG. 9 according to one embodiment.

FIG. 10 illustrates operation of the display driver IC in FIG. 9 according to one embodiment. Referring to FIGS. 9 and 10, the AP 230 toggles the first horizontal synch signal HS1 once, and then transmits the revised first image data signal DI1' to a master 210. The AP 230 toggles the second horizontal synch signal HS2 once, and then transmits the second image data signal DI2 to a slave 220.

The slave 220 may use the $800^{th}$ pixel information in the revised first image data signal DI1' to process the $801^{st}$ pixel included in the second image data signal DI2. However, the slave 220 may receive the second image data signal DI2, but may not receive the revised first image data signal DI1'.

The master 210 may use the $801^{st}$ pixel information in the second image data signal DI2 to process the $800^{th}$ pixel included in the revised first image data signal DI1'. However, the master 210 may receive the revised first image data signal DI1', but may not receive the second image data signal DI2.

The master 210 first receives the $800^{th}$ pixel information which may be used by the slave 220. Accordingly, the master 210 may transmit the $800^{th}$ pixel information to the slave 220 during the horizontal porch time.

The slave 220 first receives the $801^{th}$ pixel information which may be used by the master 210. Accordingly, the slave 220 may transmit the $801^{st}$ pixel information to the master 210 during the horizontal porch time. In one embodiment, the master 210 may revise a pixel order of the revised first image data signal DI1' to be identical to a pixel order of the first image data signal DI1.

Figure 11:
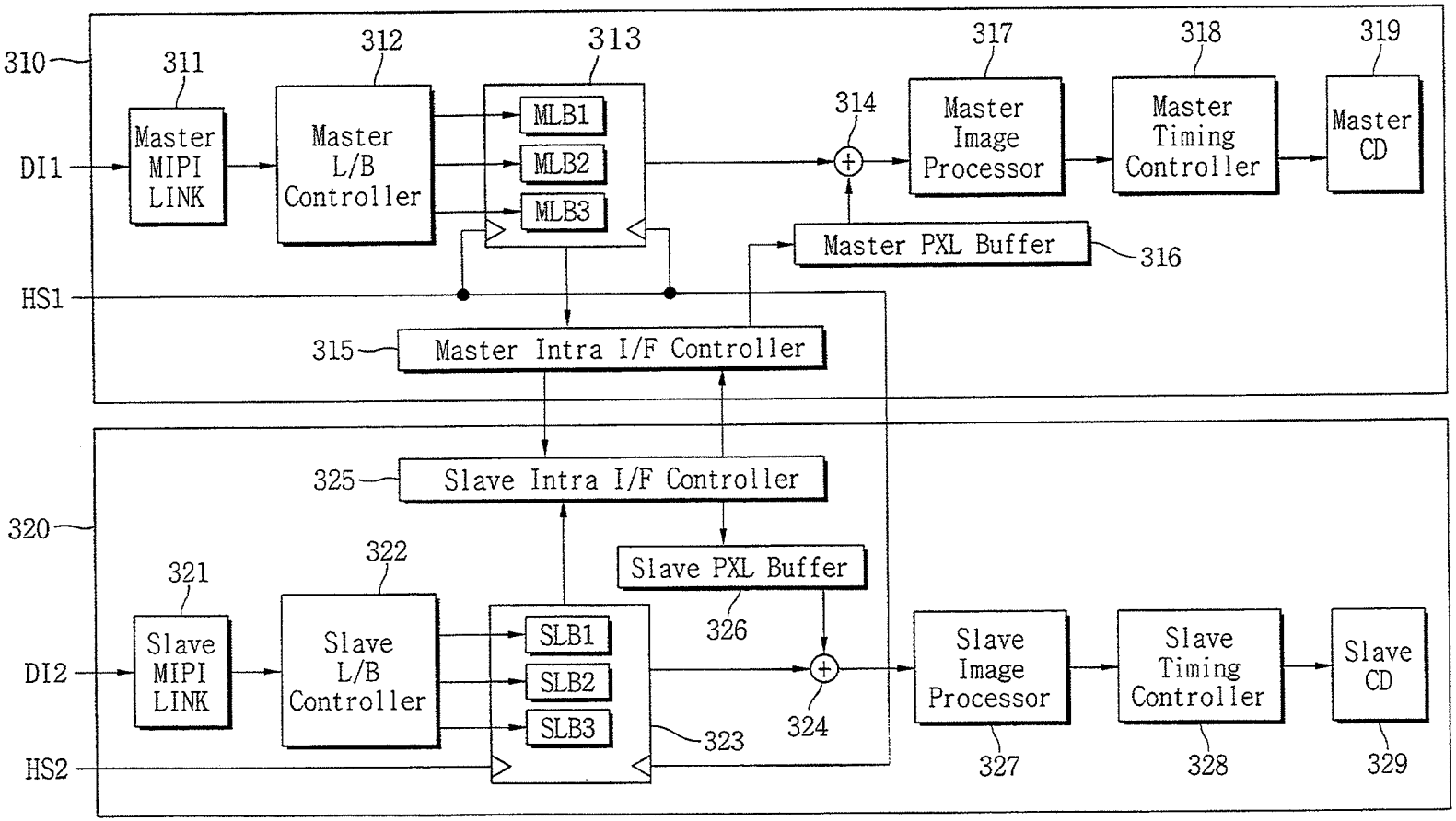
FIG. 11 illustrates another embodiment of a display driver IC.

FIG. 11 illustrating another embodiment of a display device IC 300 which includes a master 310 and a slave 320. The master 310 includes a master MIPI link 311, a master L/B controller 312, a master data buffer 313, a master summation 314, a master intra I/F controller 315, a master PXL buffer 316, a master image processor 317, a master timing controller 318, and a master CD 319.

The slave 320 includes a slave MIPI link 321, a slave L/B controller 322, a slave data buffer 323, a slave summation 324, a slave intra I/F controller 325, a slave PXL buffer 326, a slave image processor 327, a slave timing controller 328, and a slave CD 329. The master and slave 310 and 320 may have the same configuration and perform the same operations. The display driver IC 300 in FIG. 11 may have the same structure as the display driver IC 200 in FIG. 6.

The master data buffer 313 receives and outputs the first image data signal DI1 in synchronization with the first horizontal synch signal HS1. However, when the slave data buffer 323 receives and outputs the second image data signal DI2 in synchronization with the second horizontal synch signal HS2, a skew problem may occur. For example, due to a time delay, a phase of the first and second horizontal synch signals HS1 and HS2 may be different. Accordingly, a skew problem may occur in an output signal of each of the master 110 and the slave 120.

To solve this problem, each of the first to third master L/Bs MLB1 to MLB3 in the master data buffer 313 may perform a read operation and a write operation in synchronization with the first horizontal synch signal HS1. Also, each of first to third slave L/Bs SLB1 to SLB3 in the slave data buffer 323 may perform a write operation in synchronization with the second horizontal synch signal HS2 and a read operation in synchronization with the first horizontal synch signal HS1.

Figure 12A:
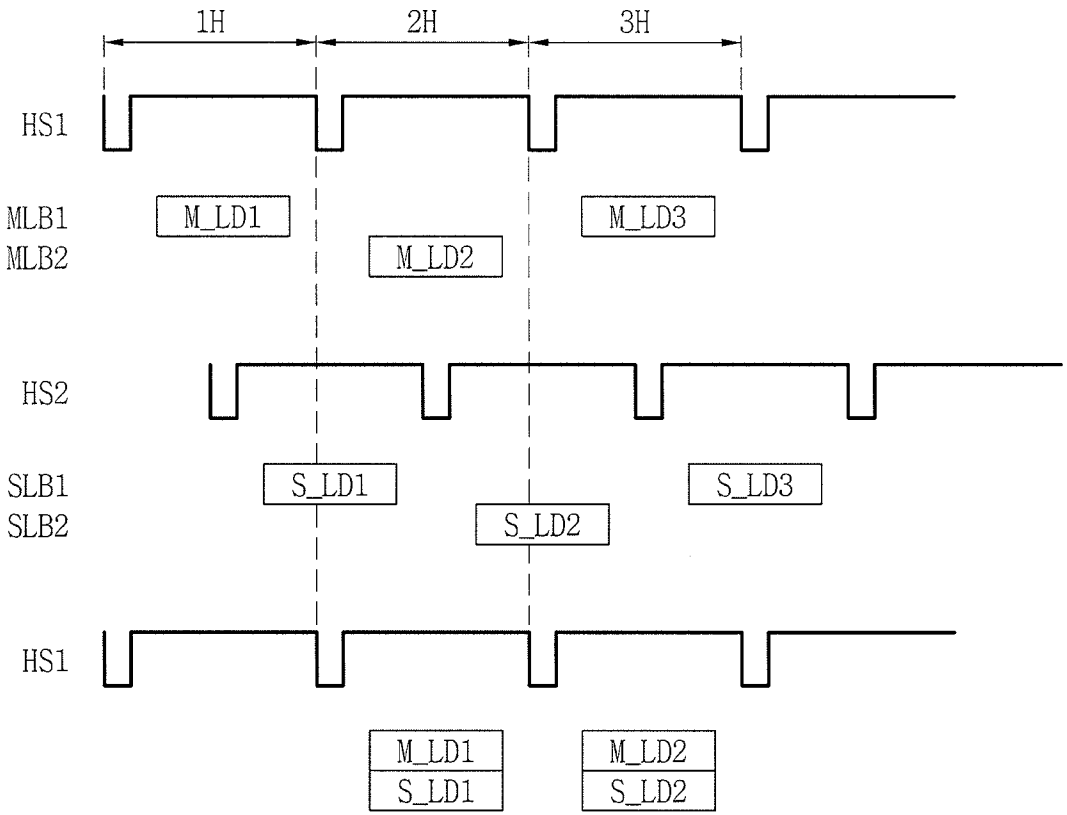
FIGS. 12A and 12B illustrate operation of the display driver IC in FIG. 11 according to one embodiment.
Figure 12B:
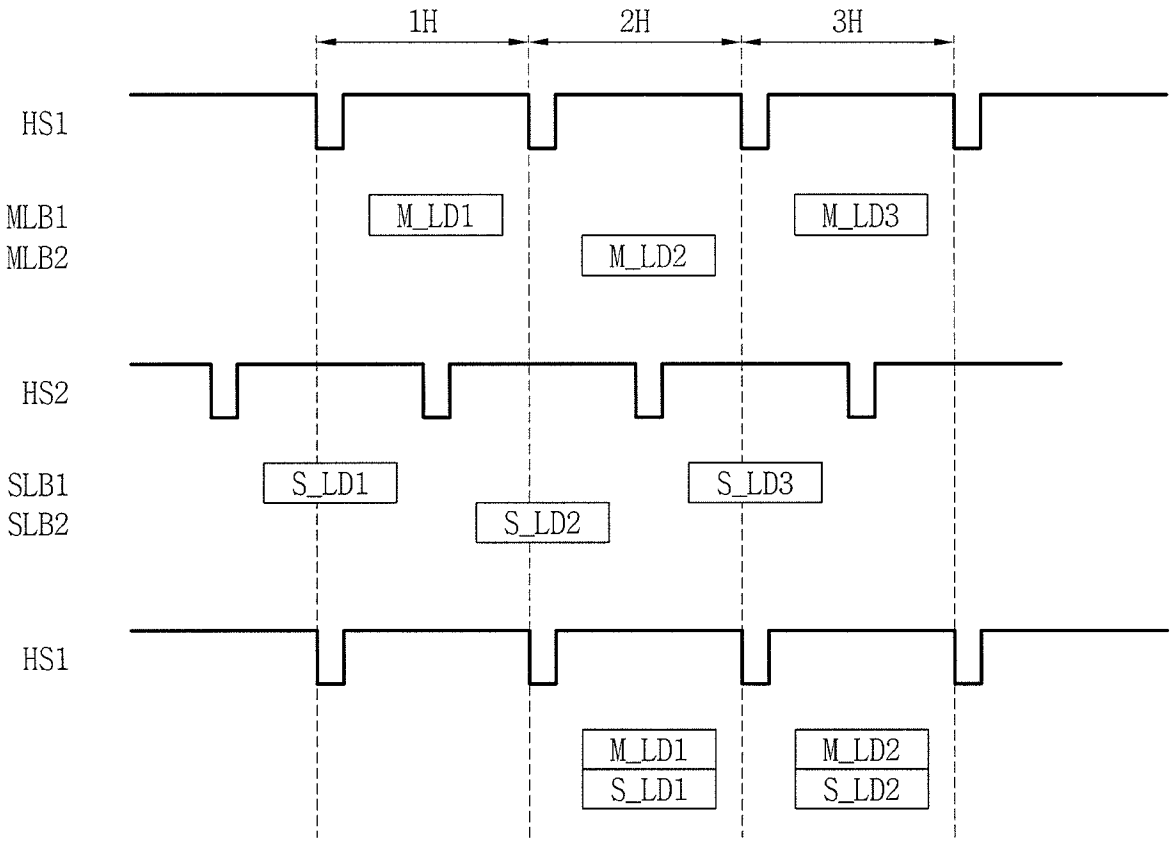

FIGS. 12A and 12B are conceptual diagrams describing operation of the display driver IC in FIG. 11 according to embodiments. Referring to FIGS. 11 and 12A, each of the first to third master L/Bs MLB1 to MLB3 may perform a dual port operation. For example, the first to third master L/Bs MLB1 to MLB3 may perform a read operation through one port and a write operation through another port. Likewise, the first to third slave L/Bs SLB1 to SLB3 may perform a dual port operation.

When the first horizontal synch signal HS1 is faster than the second horizontal synch signal HS2 by ½ H (a unit of horizontal time), a skew problem between the first and second image data signals DI1 and DI2 may occur. For example, the first image data signal DI1 may be output earlier than the second image data signal DI2 by as much as 1 H.

To solve this problem, each of the first to third masters L/Bs MLB1 to MLB3 stores and outputs the first image data signal DI1 in synchronization with the first horizontal synch signal HS1. Also, each of the first to third slave L/Bs SLB1 to SLB3 stores the second image data signal DI2 in synchronization with the second horizontal synch signal HS2 and outputs the second image data signal DI2 in synchronization with the first horizontal synch signal HS1.

For example, during the first horizontal time 1H, the master 310 stores a first master image data signal M_LD1 to the first master L/B MLB1 in synchronization with the first horizontal synch signal HS1. In addition, the slave 320 stores a first slave image data signal S_LD1 to the first slave L/B SLB1 in synchronization with the second horizontal synch signal HS2, which is slower than the first horizontal synch signal HS1 by ½ H.

During the second horizontal time 2H, the master 310 stores a second master image data signal M_LD2 to the second master L/B MLB2 in synchronization with the first horizontal synch signal HS1. In addition, the slave 320 stores a second slave image data signal S_LD2 to the second slave L/B SLB2 in synchronization with the second horizontal synch signal HS2.

The master 310 outputs the first master image data signal M_LD1 in synchronization with the first horizontal synch signal HS1. Also, the slave 320 outputs the first slave image data signal S_LD1 in synchronization with the first horizontal synch signal HS1.

During the third horizontal time 3H, the master 310 stores a third master image data signal M_LD3 to the first master L/B MLB1 in synchronization with the first horizontal synch signal HS1. In addition, the slave 320 stores a third slave image data signal S_LD3 to the first slave L/B SLB1 in synchronization with the second horizontal synch signal HS2. The master 310 outputs the second master image data signal M_LD2 in synchronization with the first horizontal synch signal HS1. The slave 320 outputs the second slave image data signal S_LD2 in synchronization with the first horizontal synch signal HS1.

Referring to FIGS. 11 and 12B, each of the first to third master L/Bs MLB1 to MLB3 may perform a dual port operation. Likewise, the first to third slave L/Bs SLB1 to SLB3 may perform a dual port operation.

When the first horizontal synch signal HS1 is slower than the second horizontal synch signal by ½ H, the second image data signal DI2 may be output earlier than the first image data signal DI1 by as much as 1 H.

To solve this problem, each of the first to third masters L/Bs MLB1 to MLB3 stores and outputs the first image data signal DI1 in synchronization with the first horizontal synch signal HS1. Also, each of the first to third slave L/Bs SLB1 to SLB3 stores the second image data signal DI2 in synchronization with the second horizontal synch signal HS2 and outputs the second image data signal DI2 in synchronization with the first horizontal synch signal HS1.

For example, the slave 320 stores the first slave image data signal S_LD1 to the first slave L/B SLB1 in synchronization with the second horizontal synch signal HS2 which is faster than the first horizontal synch signal HS1 by ½ H.

During the first horizontal time 1H, the master 310 stores the first master image data signal M_LD1 to the first master L/B MLB1 in synchronization with the first horizontal synch signal HS1. The slave 320 stores the second slave image data signal S_LD2 to the second slave L/B SLB2 in synchronization with the second horizontal synch signal HS2.

During the second horizontal time 2H, the master 310 stores the second master image data signal M_LD2 to the second master L/B MLB2 in synchronization with the first horizontal synch signal HS1. In addition, the slave 320 stores the second slave image data signal S_LD2 to the second slave L/B SLB2 in synchronization with the second horizontal synch signal HS2.

The master 310 outputs the first master image data signal M_LD1 in synchronization with the first horizontal synch signal HS1. Also, the slave 320 outputs the first slave image data signal S_LD1 in synchronization with the first horizontal synch signal HS1.

During the third horizontal time 3H, the master 310 stores the third master image data signal M_LD3 to the first master L/B MLB1 in synchronization with the first horizontal synch signal HS1. The master 310 outputs the second master image data signal M_LD2 in synchronization with the first horizontal synch signal HS1. Also, the slave 320 outputs the second slave image data signal S_LD2 in synchronization with the first horizontal synch signal HS1.

Figure 13:
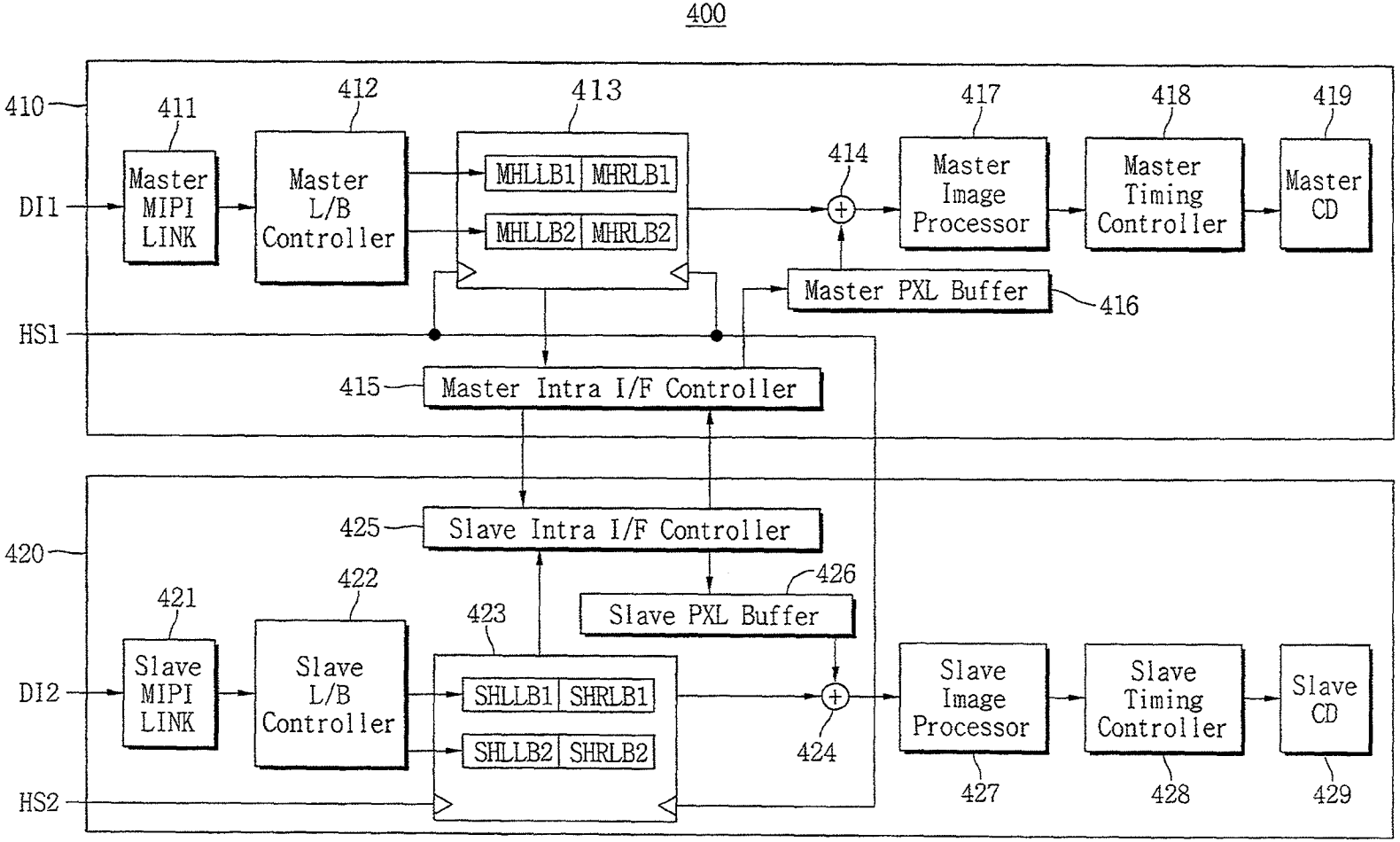
FIG. 13 illustrates another embodiment of a display driver IC.

FIG. 13 illustrates another embodiment of a display driver IC 400 which includes a master 410 and a slave 420. The master 410 includes a master MIPI link 411, a master L/B controller 412, a master data buffer 413, a master summation 414, a master intra I/F controller 415, a master PXL buffer 416, a master image processor 417, a master timing controller 418, and a master CD 419. The master data buffer 413 includes a first master half left L/B MHLLB1, a first master half right L/B MHRLB1, a second master half left L/B MHLLB2, and a second master half right L/B MHRLB2.

The slave 420 includes a slave MIPI link 421, a slave L/B controller 422, a slave data buffer 423, a slave summation 424, a slave intra I/F controller 425, a slave PXL buffer 426, a slave image processor 427, a slave timing controller 428, and a slave CD 429. The slave data buffer 423 includes a first slave half left L/B SHLLB1, a first slave half right L/B SHRLB1, a second slave half left L/B SHLLB2, and a second slave half right L/B SHRLB2.

The master 410 and slave 420 may have the same configuration and perform the same operations. The display driver IC 400 shown in FIG. 13 has the same structure as the display driver IC 300 in FIG. 11.

When the master data buffer 413 and slave data buffer 423 have a L/B which cannot perform a dual port operation, a skew problem between the first image data signal DI1 and the second image data signal DI2 may be not solved using the method in FIGS. 12A and 12B.

To solve this problem, each of the first master half left L/B MHLLB1 and the first master half right L/B MHRLB1 may independently perform a read operation or a write operation. Also, each of the second master half left L/B MHLLB2 and the second master half right L/B MHRLB2 may independently perform a read operation or a write operation.

Further, the master half data buffer 413 and the slave half data buffer 423 may include the same configuration.

The master 410 may store the first image data signal DI1, which is first received, to the first master half left L/B MHLLB1 and the first master half right L/B MHRLB1. Further, the master 410 may store the first image data signal DI1, which is second received, to the second master half left L/B MHLLB2 and the second master half right L/B MHRLB2.

The slave 420 may store the second image data signal DI2, which is first received, to the first slave half left L/B SHLLB1 and the first slave half right L/B SHRLB1. Further, the slave 420 may store the second image data signal DI2, which is second received, to the second slave half left L/B SHLLB2 and the second slave half right L/B SHRLB2.

Figure 14:
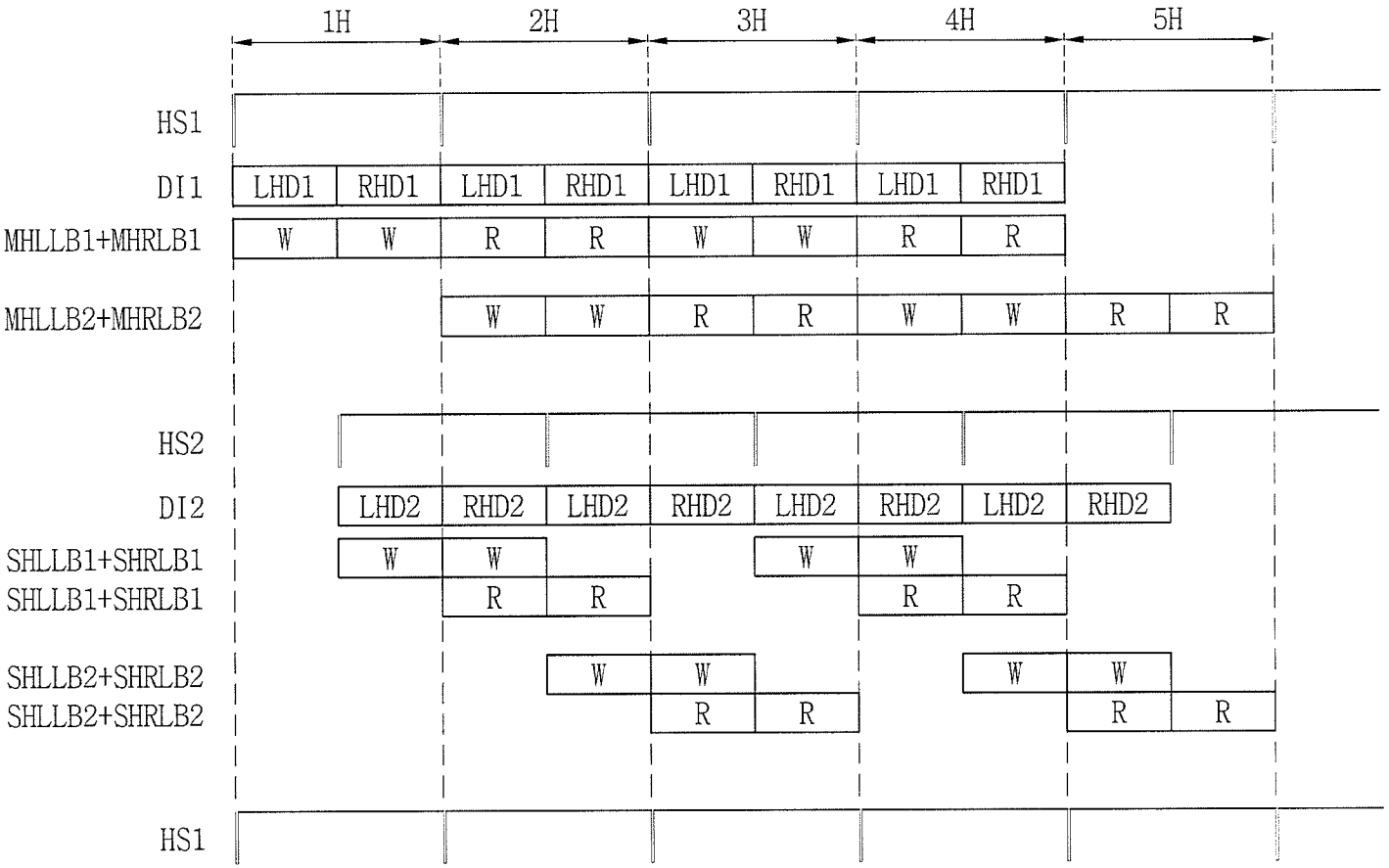
FIG. 14 illustrates operation of the display driver IC in FIG. 13 according to one embodiment.

FIG. 14 illustrates operation of the display driver IC 400 in FIG. 13 according to one embodiment. Referring to the FIGS. 13 and 14, the first image data signal DI1 includes a first left half data LHD1 and a first right half data RHD1. Likewise, the second image data signal DI2 includes a second left half data LHD2 and a first right half data RHD2.

During the first horizontal time 1H, the first master half left L/B MHLLB1 stores the first left half data LHD1, which is received first, in synchronization with the first horizontal synch signal HS1. In addition, the first master half right L/B MHRLB1 stores the first right half data RHD1, which is first received, in synchronization with the first horizontal synch signal HS1. The first slave half left L/B SHLLB1 stores the second left half data LHD2, which is first received, in synchronization with the second horizontal synch signal HS2 which is slower than the first horizontal synch signal HS1 by ½ H.

During the second horizontal time 2H, the first master half left L/B MHLLB1 outputs the first left half data LHD1, which is received first, in synchronization with the first horizontal synch signal HS1. In addition, the first master half right L/B MHRLB1 outputs the first right half data RHD1, which is first received, in synchronization with the first horizontal synch signal HS1.

Further, the second master half left L/B MHLLB2 stores the first left half data LHD1, which is received second, in synchronization with the first horizontal synch signal HS1. Also, the second master half right L/B MHRLB2 stores the first right half data RHD1, which is second received, in synchronization with the first horizontal synch signal HS1.

The first slave half right L/B SHRLB1 stores the second right half data RHD2, which is first received, in synchronization with the second horizontal synch signal HS2. Further, the first slave half left L/B SHLLB1 outputs the second left half data LHD2, which is first received, in synchronization with the first horizontal synch signal HS1. Also, the first slave half right L/B SHRLB1 stores the second right half data RHD2, which is first received, in synchronization with the first horizontal synch signal HS1.

The second slave half left L/B SHLLB2 stores the second left half data LHD2, which is second received, in synchronization with the second horizontal synch signal HS2.

During the third horizontal time 3H, the first master half left L/B MHLLB1 stores the first left half data LHD1, which is received third, in synchronization with the first horizontal synch signal HS1. In addition, the first master half right L/B MHRLB1 stores the first right half data RHD1, which is third received, in synchronization with the first horizontal synch signal HS1.

Further, the second master half left L/B MHLLB2 outputs the first left half data LHD1, which is received second, in synchronization with the first horizontal synch signal HS1. Also, the second master half right L/B MHRLB2 outputs the first right half data RHD1, which is second received, in synchronization with the first horizontal synch signal HS1.

The second slave half left L/B SHLLB2 stores the second left half data LHD2, which is second received, in synchronization with the second horizontal synch signal HS2. Further, the second slave half left L/B SHLLB2 outputs the second left half data LHD2, which is second received, in synchronization with the first horizontal synch signal HS1. Also, the second slave half right L/B SHRLB2 stores the second right half data RHD2, which is second received, in synchronization with the first horizontal synch signal HS1.

The first slave half left L/B SHLLB1 stores the second right half data RHD2, which is third received, in synchronization with the second horizontal synch signal HS2.

During the fourth horizontal time 4H, the first master half left L/B MHLLB1 outputs the first left half data LHD1, which is received third, in synchronization with the first horizontal synch signal HS1. In addition, the first master half right L/B MHRLB1 outputs the first right half data RHD1, which is third received, in synchronization with the first horizontal synch signal HS1.

Further, the second master half left L/B MHLLB2 stores the first left half data LHD1, which is received fourth, in synchronization with the first horizontal synch signal HS1. Also, the second master half right L/B MHRLB2 stores the first right half data RHD1, which is fourth received, in synchronization with the first horizontal synch signal HS1.

The first slave half right L/B SHRLB1 stores the second right half data RHD2, which is third received, in synchronization with the second horizontal synch signal HS2. Further, the first slave half left L/B SHLLB1 outputs the second left half data LHD2, which is third received, in synchronization with the first horizontal synch signal HS1. And, the first slave half right L/B SHRLB1 outputs the second right half data RHD2, which is third received, in synchronization with the first horizontal synch signal HS1.

The second slave half left L/B SHLLB2 stores the second left half data LHD2, which is fourth received, in synchronization with the second horizontal synch signal HS2.

During the fifth horizontal time 5H, the second master half left L/B MHLLB2 outputs the first left half data LHD1, which is fourth received, in synchronization with the first horizontal synch signal HS1. In addition, the second master half right L/B MHRLB2 outputs the first right half data RHD1, which is fourth received, in synchronization with the first horizontal synch signal HS1.

The second slave half right L/B SHRLB2 stores the second right half data RHD2, which is fourth received, in synchronization with the second horizontal synch signal HS2. Further, the second slave half left L/B SHLLB2 outputs the second left half data LHD2, which is received fourth, in synchronization with the first horizontal synch signal HS1. Also, the second slave half right L/B SHRLB2 outputs the second right half data RHD2, which is received fourth, in synchronization with the first horizontal synch signal HS1.

Figure 15:
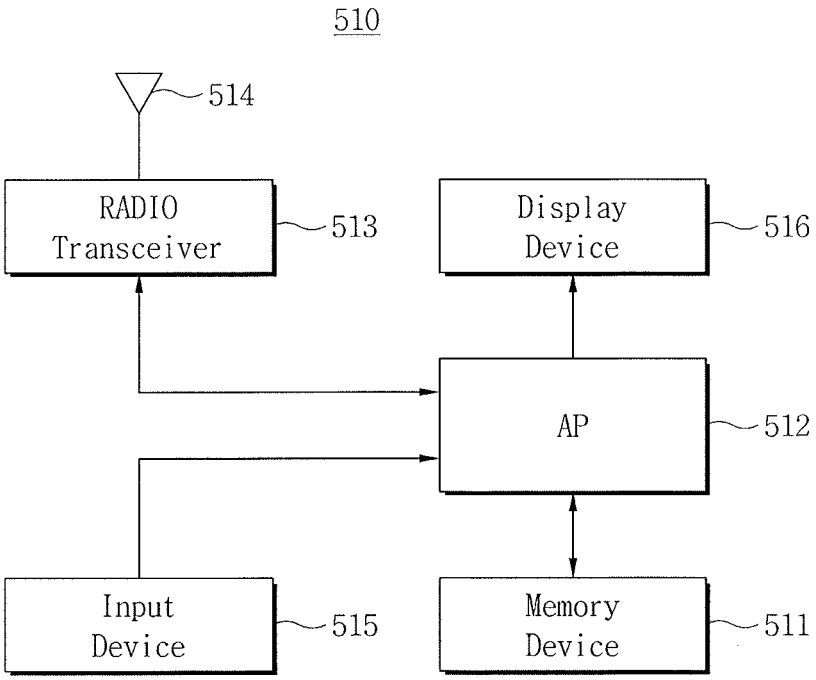
FIG. 15 illustrates an embodiment of a computer system including the display driver IC in FIG. 2.

FIG. 15 illustrates an embodiment of a computer system 510 including a display driver IC, which, for example, may be the one in FIG. 2. Referring to FIG. 15, the computer system 510 includes a memory device 511, an AP 512 including a memory controller for controlling the memory device 511, a radio transceiver 513, an antenna 514, an input device 515, and a display device 516.

The radio transceiver 513 transmits and receives a radio signal through the antenna 514. For example, the radio transceiver 513 converts the radio signal received through the antenna 514 into a signal which may be processed in the AP 512. Accordingly, the AP 512 processes a signal output from the radio transceiver 513, and transmits the processed signal to the display device 516.

Further, the radio transceiver 513 converts the signal output from the AP 512 into the radio signal, and transmits the converted radio signal to an external device through the antenna 514.

The input device 515 inputs a control signal for controlling operation of the AP 512 or data to be processed by the AP 512. The input device 515 may be, for example, a pointing device such as but not limited to a touchpad, a computer mouse, a keypad, and/or a keyboard. The display device 516 may include the display driver IC in FIG. 2.

Figure 16:
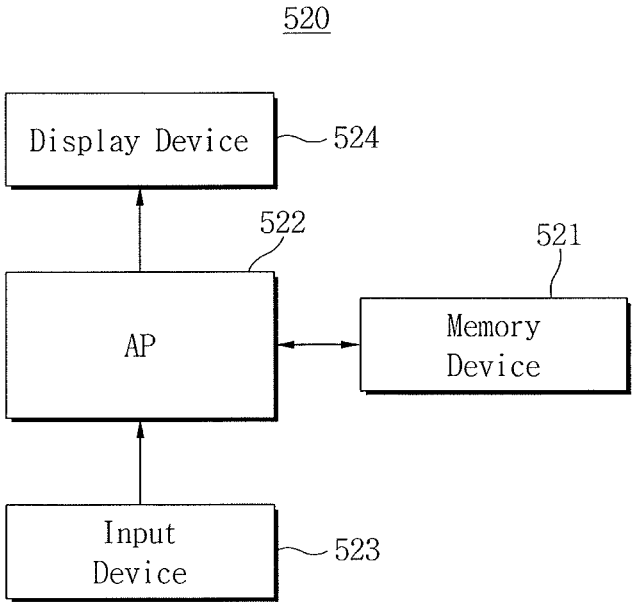
FIG. 16 illustrates another embodiment of a computer system including the display driver IC in FIG. 2.

FIG. 16 illustrates another embodiment of a computer system 520 including a display driver IC, which, for example, may be the display driver IC in FIG. 2. Referring to FIG. 16, the computer system 520 may be a personal computer (PC), a network server, a tablet PC, a netbook, an e-reader, a personal digital assistant (PDA), a portable multimedia player (PMP), an MP3 player, or an MP4 player.

The computer system 520 includes a memory device 521, an AP 522 including a memory controller for controlling a data processing operation of the memory device 521, an input device 523, and a display device 524.

The AP 522 displays data stored in the memory device 521 through the display device 524 according to data input through the input device 523. For example, the input device 523 may be a pointing device such as but not limited to a touchpad, a computer mouse, a keypad, and/or a keyboard. The AP 522 may control overall operations of the computer system 520 and the memory device 521. The display device 524 may include the display driver IC in FIG. 2.

Figure 17:
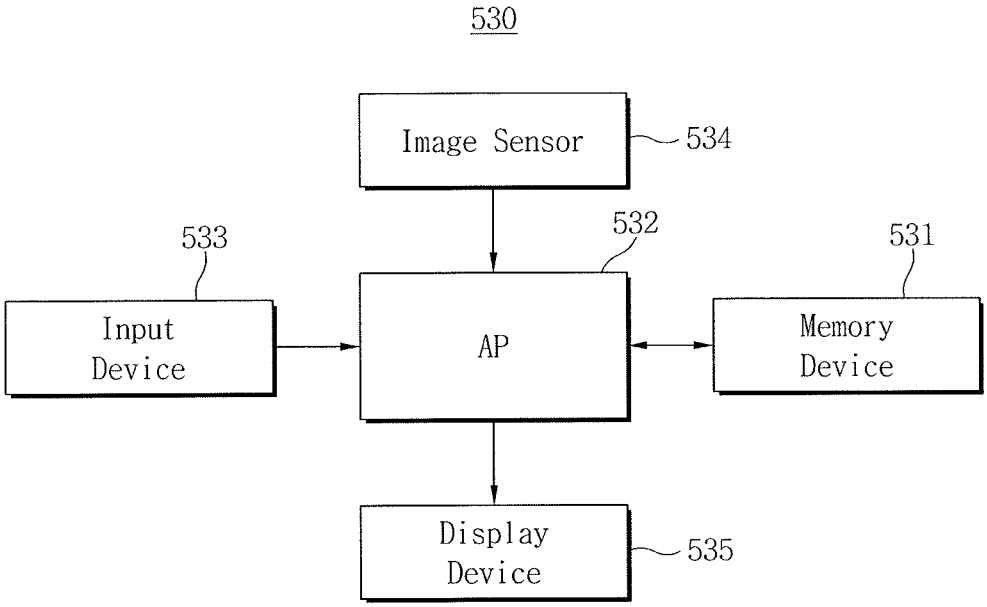
FIG. 17 illustrates another embodiment of a computer system including the display driver IC in FIG. 2.

FIG. 17 illustrates another embodiment of a computer system 530 including a display driver IC, which, for example, may be the display driver IC in FIG. 2. Referring to FIG. 17, the computer system 530 may be an image processing device, for example, a digital camera, or a mobile phone, a smartphone or a tablet PC on which the digital camera is installed.

The computer system 530 further includes a memory device 531, an AP 532 including a memory controller for controlling a data processing operation, for example, a write operation or a read operation, of the memory device 531, an input device 533, an image sensor 534, and a display device 535.

The input device 533 inputs a control signal for controlling operation of the AP 532 or data to be processed by the AP 532. The input device 533 and may be, for example, a pointing device such as but not limited to a touchpad, a computer mouse, a keypad, and/or a keyboard.

The image sensor 534 of the computer system 530 converts an optical image into digital signals. The converted digital signals are transmitted to the AP 532. According to control of the AP 532, the converted digital signals are displayed through the display device 535, or stored in the memory device 531. The display device 535 may include the display driver IC in FIG. 2.

In accordance with one or more of the aforementioned embodiments, a display driver IC is provided which may process image data when dividing and processing image data. These embodiments may be applied to a display driver IC which controls a display panel.

Example embodiments have been disclosed herein, and although specific terms are employed, they are used and are to be interpreted in a generic and descriptive sense only and not for purpose of limitation. In some instances, as would be apparent to one of skill in the art as of the filing of the present application, features, characteristics, and/or elements described in connection with a particular embodiment may be used singly or in combination with features, characteristics, and/or elements described in connection with other embodiments unless otherwise indicated. Accordingly, it will be understood by those of skill in the art that various changes in form and details may be made without departing from the spirit and scope of the present invention as set forth in the following claims.

What is claimed is:

1. A display driver integrated circuit (IC), comprising:

a first driver IC to receive a first image data signal from a host; and a second driver IC to receive a second image data signal from the host, wherein the first driver IC is to transmit a first part of the first image data signal to the second driver IC, and the second driver IC is to transmit a second part of the second image data signal to the first driver IC, wherein the first driver IC is to process the first image data signal by using the second part and the second driver IC is to process the second image data signal by using the first part, and wherein the first part includes some pixel information of the first image data signal for boundary image processing and the second part includes some pixel information of the second image data signal for boundary image processing.

2. The IC as claimed in claim 1, wherein the first driver IC is to process the first image data signal using the second part and is to transmit the processed first image data signal to a display panel.

3. The IC as claimed in claim 2, wherein:

when the first image data signal includes pixel information corresponding to a left region of the display panel, the first part includes pixel information corresponding to a boundary of the left region.

4. The IC as claimed in claim 3, wherein an order of pixels in the first image data signal are to be inverted by an application processor in the host.

5. The IC as claimed in claim 1, wherein the second driver IC is to process the second image data signal using the first part and is to transmit the processed second image data signal to a display panel.

6. The IC as claimed in claim 5, wherein:

when the second image data signal includes pixel information corresponding to a right region of the display panel, the second part includes pixel information corresponding to a boundary of the right region.

7. The IC as claimed in claim 1, wherein the first driver IC includes:

a first data buffer including at least one first line buffer to store the first image data signal;

a first line buffer controller to control the at least one first line buffer; and a first intra interface controller to transmit the first part and to receive the second part.

8. The IC as claimed in claim 7, wherein the second driver IC includes:

a second data buffer including at least one second line buffer to store the second image data signal;

a second line buffer controller to control the at least one second line buffer; and a second intra interface controller to transmit the second part and receive the first part.

9. The IC as claimed in claim 8, wherein:

the first data buffer is to receive the first image data signal in synchronization with a first horizontal synch signal and is to output the first image data signal to a display panel in synchronization with the first horizontal synch signal, and the second data buffer is to receive the second image data signal in synchronization with a second horizontal synch signal and is to output the second image data signal in synchronization with the first horizontal synch signal to the display panel.

10. The IC as claimed in claim 9, wherein:

each of the at least one first and second line buffers includes a half left line buffer and a half right line buffer, and each of the half left line buffer and the half right line buffer independently performs a read operation or a write operation.

11. A mobile device, comprising:

an application processor; and a display driver IC to receive first and second image data signals from the application processor, wherein the display driver IC includes:

a first driver IC to receive a first image data signal from a host; and a second driver IC to receive a second image data signal from the host, wherein the first driver IC is to transmit a first part of the first image data signal to the second driver IC, and the second driver IC is to transmit a second part of the second image data signal to the first driver IC, wherein the first driver IC is to process the first image data signal by using the second part, and the second driver IC is to process the second image data signal by using the first part, and wherein the first part includes some pixel information of the first image data signal for boundary image processing and the second part includes some pixel information of the second image data signal for boundary image processing.

12. The mobile device as claimed in claim 11, wherein the first driver IC is to process the first image data signal using the second part and is to transmit the processed first image data signal to a display panel.

13. The mobile device as claimed in claim 12, wherein:

when the first image data signal includes pixel information corresponding to a left region of the display panel, the first part includes pixel information corresponding to a boundary of the left region.

14. The mobile device as claimed in claim 11, wherein the second driver IC is to process the second image data signal using the first part and is to transmit the processed second image data signal to a display panel.

15. The mobile device as claimed in claim 14, wherein:

when the second image data signal includes pixel information corresponding to a right region of the display panel, the second part includes pixel information corresponding to a boundary of the right region.

16. An apparatus, comprising:

a first driver to process a first image data signal; and a second driver to process a second image data signal, wherein the first data signal includes pixel information corresponding to a first region of an image and the second data signal includes pixel information corresponding to a second region of the image, and wherein the first driver is to transfer a portion of the first image data signal to the second driver during a horizontal porch time and the second driver is to transfer a portion of the second image data signal to the first driver during the horizontal porch time to generate the image, and wherein the portion of the first image data signal includes some pixel information of the first image data signal for boundary image processing and the portion of the second image data signal includes some pixel information of the second image data signal for boundary image processing.

17. The apparatus as claimed in claim 16, wherein:

the first driver includes a first controller to process the first image data signal for output through a first set of column drivers, and the second driver includes a second controller to process the second image data signal through a second set of column drivers.

18. The apparatus as claimed in claim 17, wherein the first driver and the second driver are included in different integrated circuit (IC) chips.

19. The apparatus as claimed in claim 16, wherein:

the first driver is to process the first image data signal based on the portion of the second image data signal transferred from the second driver, and the second driver is to process the second image data signal based on the portion of the first image data signal transferred from the first driver.

20. The apparatus as claimed in claim 16, wherein at least one of the portion of the first image data signal or the portion of the second image data signal corresponds to a boundary between the first region and the second region of the image.

* * * * *